US006814542B2

(12) United States Patent
Märländer et al.

(10) Patent No.: US 6,814,542 B2
(45) Date of Patent: Nov. 9, 2004

(54) BLOWER ESPECIALLY FOR VENTILATING ELECTRONIC DEVICES

(75) Inventors: Thomas Märländer, Oberndorf (DE); Christof Huonker, Villingen-Schwenningen (DE); Andreas Kienzler, Villingen-Schwenningen (DE)

(73) Assignee: Verax Ventilatoren GmbH (DE)

( * ) Notice: Subject to any disclaimer, the term of this patent is extended or adjusted under 35 U.S.C. 154(b) by 0 days.

(21) Appl. No.: 10/258,787

(22) PCT Filed: Mar. 15, 2001

(86) PCT No.: PCT/EP01/02943

§ 371 (c)(1),
(2), (4) Date: Oct. 28, 2002

(87) PCT Pub. No.: WO01/83994

PCT Pub. Date: Nov. 8, 2001

(65) Prior Publication Data

US 2003/0077175 A1 Apr. 24, 2003

(30) Foreign Application Priority Data

Apr. 28, 2000 (DE) ..... 100 20 878

(51) Int. Cl.[7] ..... F04D 29/52

(52) U.S. Cl. ..... 415/219.1; 415/221; 416/170 R; 416/243

(58) Field of Search ..... 415/218.1, 219.1, 415/221; 416/170 R, 234, 243; 417/420, 423.7

(56) References Cited

U.S. PATENT DOCUMENTS

| | | | | | |
|---|---|---|---|---|---|
| 2,434,896 | A | * | 1/1948 | Ayers | 415/218.1 |
| 3,102,679 | A | * | 9/1963 | Rudy | 417/84 |
| 4,618,315 | A | * | 10/1986 | Papst et al. | 417/354 |
| 4,909,711 | A | * | 3/1990 | Burgbacher et al. | 417/354 |
| 5,695,318 | A | * | 12/1997 | Harmsen | 415/218.1 |

* cited by examiner

*Primary Examiner*—Ninh H. Nguyen
(74) *Attorney, Agent, or Firm*—Pendorf & Cutliff

(57) ABSTRACT

The invention relates to a blower, especially for a personal computer. The air of the invention is to reduce the noise produces by such a blower. To this end, the inventive blower comprises: a) a blower housing (10) including a guide surface (22) that defines the exterior limits of a flow channel (24); b) a hub (14) that is mounted in the blower housing (10) so as to be rotatable about an axis of rotation (12) and having a hub surface (18) that defines the interior limits of the flow channel (24); c) a rotary drive (20) for the hub (18) which is disposed within the hub (14); d) the blades (16) of the hub (18) are asymmetrically distributed about the periphery of the hub (14) and are configured as radial blades; and e) the guide surface (22) and the hub (14), in the blade zone between the leading edge (34) of the blade and the trailing edge (36) of the blade, when looked at in the direction of flow, have a generally conical or slightly curved and widening shape, and the area of cross-section of flow along the flow channel (24) remains constant or is reduced.

15 Claims, 1 Drawing Sheet

BLOWER ESPECIALLY FOR VENTILATING ELECTRONIC DEVICES

This application is a national stage of PCT/EP01/02943 filed Mar. 15, 2001 and based upon DE 100 20 878.9 filed Apr. 28, 2000 under the International Convention.

BACKGROUND OF THE INVENTION

1. Field of the Invention

The invention concerns a blower or fan, in particular for ventilating or, as the case may be, cooling of electronic devices such as personal computers.

2. Description of the Related Art

Conventionally, axial blowers with a flat design have been employed for this purpose, and include a cylindrical ring space as flow channel and diagonally arranged blades. The air thus flows axially through the impeller. Therewith a small pressure differential can result in high volumetric flow. When transitioning to higher pressure differentials, however, instabilities occur, which lead to fluttering or strong turbulence and therewith increasingly to undesirable noise production.

Besides this, radial blowers are known, for example from hair dryers, which can develop greater pressure differential and which can overcome higher resistance to flow. Such fans are however generally unsuitable as components in PC-housings due to the low conveyance volume due to their radial or as the case may be tangential flow of air. Also known are hybrids, known in particular as the so-called half-axial fans, which include a diagonal flow component with blades arranged diagonally in the blade zone. Such fans however also are liable to noise disadvantages in computer applications.

SUMMARY OF THE INVENTION

Beginning therewith, it is the task of the invention to provide a fan, which avoids the above-mentioned disadvantages and provides high efficiency with low noise development with respect to efficient ventilation and cooling. Besides this, the design should be suitable for incorporation into a computer housing and meet typical system performance requirements.

The invention is based on the idea, of employing a fan with a radial wheel with diagonal flow path, in order to achieve a broad and suitable working range. In accordance therewith an inventive fan is proposed having the following characteristics:

- a blower housing including a guide surface defining the exterior limits of a flow channel,
- a hub that is mounted in the blower housing so as to be rotatable about an axis of rotation and that defines the interior limits of the the flow channel,
- a rotary drive for the hub which is disposed within the hub,
- the blades of the hub are asymmetrically distributed about the periphery of the hub and are configured as radial blades,
- the guide surface and the hub, in the blade zone between the leading edge of the blade and the trailing edge of the blade, when looked at in the direction of flow, have a conical or slightly bent and widening shape, and the cross-flow surface area inside the flow channel remains constant or decreases.

Therewith, using a compact axial design, a radial type of operation is achieved. In comparison to axial fans or blowers the direction of blowing is only changed slightly, while with similar volumetric flows a significant pressure boost is achieved. The special design for the guidance of the flow channel diagonally through the impeller results in a continuous impedance curve and makes possible therewith an optimization of the work point over a broad range. In particular, due to the low circumferential speed differences, no noise producing disturbances or interruptions in the flow occur until higher pressures in the upper range of the impedance curve. The system requirements of PC's conventionally do not lie within this range. In this sense, the longer flow path also has a positive effect.

In order to maintain the flow cross-section approximately constant, the guide surface of the housing should, in the blade zone, be of smaller pitch axially than the hub. Therein it is further of advantage, when the guide surface in the blade zone has essentially the shape of a truncated cone with a cone angle of between 20° and 60°, preferably 40°, and when the hub in the blade zone has essentially the shape of a truncated cone with a cone angle of between 80° and 110°, preferably 95°.

For the further reduction of noise production it is of advantage when the cone is parabolic, at least in its crown. It is also desirable, when the entry part of the guide surface is rounded along a radius.

Preferably the entry and exit of the flow channels respectively have opposing radial coverings.

According to a particularly preferred design of the invention the blade trailing edge forms an acute angle of incidence relative to the plane of the exit opening of the flow channel set against the direction of flow. It should be ensured that the angle of incidence is between 10° and 20°, preferably 15°. Therewith it is achieved, that on the downstream side turbulence and, correspondingly, noise development is minimized.

A further improvement is achieved thereby, that the free or outer blade edges run adjacent the guide surface, maintaining a tolerance gap as necessary for clearance.

For increasing the inlet cross-section between the blades it is advantageous when the blade entry edges extend axially upstream of the hub, projecting out towards the entry opening.

A further improvement in aerodynamic effect envisions that the blade entry edge exhibits a radius of curvature of 1% to 4% as well as a profile thickness of 2% to 8% based on the length of the free blade end (outer) edge.

For driving the impeller there is preferably employed an electric motor designed as an external running motor in a recess of the hub.

BRIEF DESCRIPTION OF THE DRAWINGS

In the following the invention will be described on the basis of the embodiment shown in schematic manner in the drawing. There is shown FIG. 1 a fan for a PC device in top view in the direction of flow.

DETAILED DESCRIPTION OF THE INVENTION

Figure 1:
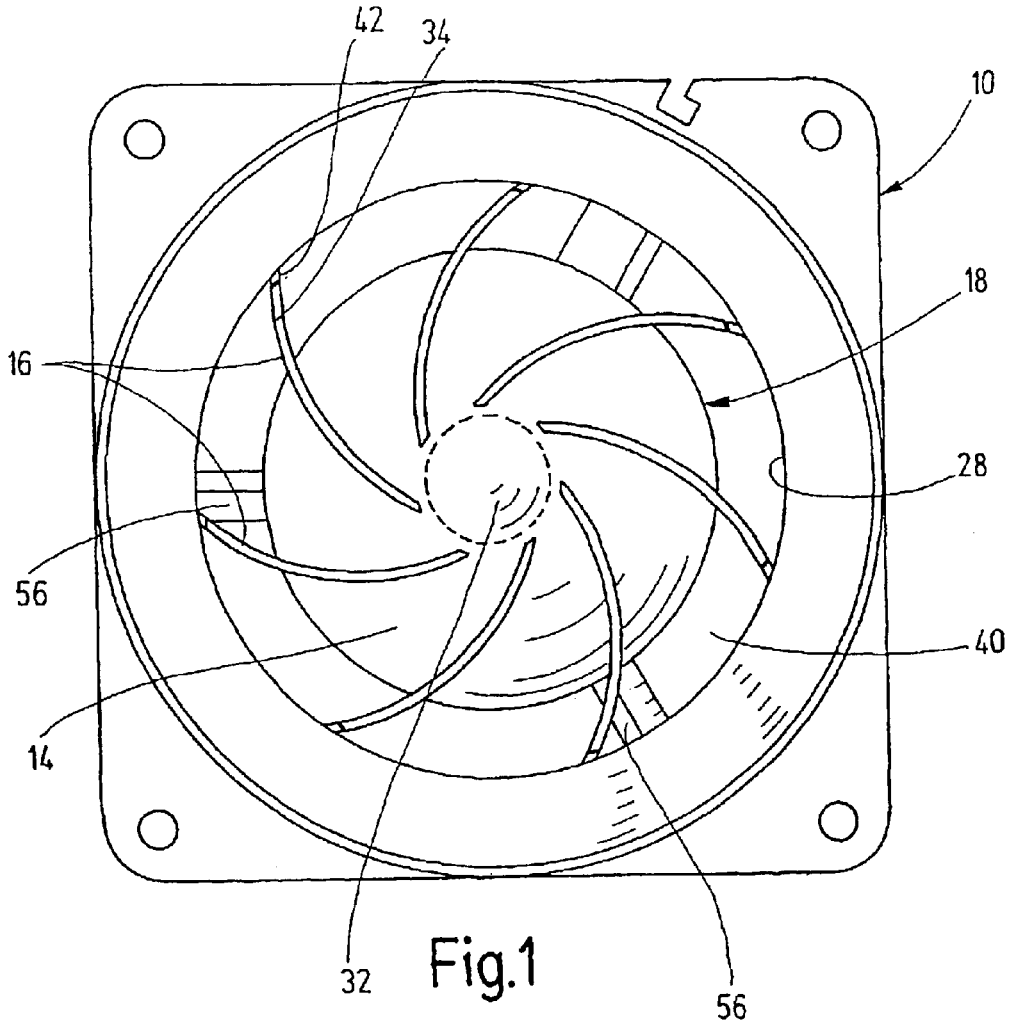

The fan shown in the drawing is comprised essentially of a housing 10, an impeller 18 comprising blades 16 provided on hub 14 mounted to be rotatable about an axis of rotation 12, and a rotational drive 20 for the impeller 18.

The inner casing of the housing 10 describes the guide surface 22 for the outer side of a flow channel 24, while the hub 14 provided concentric to the guide surface 22 defines the inner side of the flow channel 24.

Figure 2:
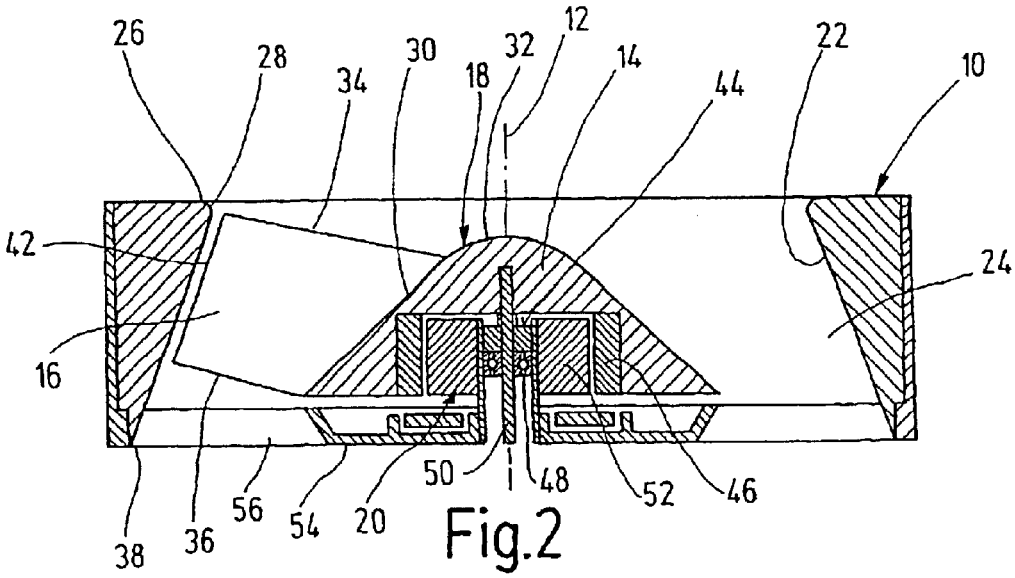
FIG. 2 a fan according to FIG. 1, with simplified contour representation of the blades, in axial section.

As can be seen from FIG. 2, the guide surface 22, with the exception of its entry part 26, exhibits a shape of a truncated cone, widening—except in the area of the entrance in the direction of the flow, downwards in FIG. 2, wherein the cone wall angle is approximately 40°. The entry part 26, limited by the entry opening 28 of the flow channel 24, is rounded going outwards along the entry radius. This radius should be kept as great as possible, in order to avoid the production of turbulence at the entry side. It is basically also possible, that the guide surface is slightly curved in the form of a truncated parabola.

In the foot area 30 of the blades 16 the hub 14 is in the form of a truncated cone, wherein the cone angle in the shown embodiment is 95°. In the inside of the entry opening 28 facing crown area 32 the hub 14 is in the form of a parabola, in order to minimize turbulences. It is also conceivable that the hub 14 has overall the shape of a parabola, in certain cases with rounded-out outflow edge. In any case it is to be accomplished, that the guide surface 22 in the blade zone, that is, between the blade entry edge 34 and the blade exit edge 36, exhibits a greater increase expanding in the direction of the axis of rotation 12 than the hub 14, so that the central diameter of the circular ring shaped flow channel 24 continuously widens with constant or slightly reducing flow through surface area. Thereby a radial coverage or overlap exists between entry opening 28 and exit opening 28 of the flow channel 24, so that a ring area 40 is axially open all the way through.

The blades 16 are arranged asymmetrically for avoidance of resonance over the circumference of the hub 14 and lie as pure radial blades running parallel to the axis of rotation 12 against the direction of rotation (counterclockwise in FIG. 1) backwards curved cylinder surfaces.

The blade leading edge 34 extends axially in advance of the crown area 32 of the hub 14 towards the entry opening 28 and has a curvature radius of 1% to 4% as well as a profile thickness of 2% to 8% of the length of the free blade end edges 42, maintaining a tolerance gap running along the guide surface 22. For minimizing noise the blade trailing or exit edges 36 towards the blade end set a sharp or acute angle of incidence relative to the plane of the exit opening 38 against the flow through direction, wherein the angle of incidence in the shown embodiment is approximately 15°.

The whole impeller 18 is preferably a one-piece design, made of injection molded plastic. Therein it is preferred, considering demolding, that the blades 16 do not overlap in the direction of rotation.

The rotation drive 20 is comprised of an outer-rotor electric motor, which is disposed within a cylindrical recess 44 of the hub 14. The rotor 46 is therein connected fixedly with the hub 14, which via hub shaft 50 riding on roller bearings 48 is seated on the stator 52, which via ring flange 54 and therefrom radially projecting frame projections 56 is secured on the exit side of the housing.

In summary the following can be concluded: The invention concerns a fan, in particular for personal computers, in which for noise reduction the following combination of characteristics is proposed:

a blower housing (10) including a guide surface (22) that defines the exterior limits of a flow channel (24), a hub (14) that is mounted in the blower housing (10) so as to be rotatable about an axis of rotation (12) and having a hub surface (18) that defines the interior limits of the flow channel (24), a rotary drive (20) for the hub (18) which is disposed within the hub (14), the blades (16) of the hub (18) are asymmetrically distributed about the periphery of the hub (14) and are configured as radial blades, the guide surface (22) and the hub (14), in the blade zone between the leading edge (34) of the blade and the trailing edge (36) of the blade, when looked at in the direction of flow, have a generally conical or slightly curved and widening shape, and the area of cross-section of flow along the flow channel (24) remains constant or is reduced.

What is claimed is:

1. A blower, including:

a) a blower housing (10) including a guide surface (22) that defines the exterior limits of a flow channel (24);

b) a hub (14) that is mounted in the blower housing (10) so as to be rotatable about an axis of rotation (12) and having a hub surface (18) that defines the interior limits of the flow channel (24);

c) a rotary drive (20) for the hub (18) which is disposed within the hub (14);

d) the blades (16) of the hub (18) are configured as radial blades with cylindrical surfaces extending parallel to the axis of rotation (12) and curved backwards against the direction of rotation; and e) the guide surface (22) and the hub (14), in the blade zone between the leading edge (34) of the blade and the trailing edge (36) of the blade, viewed in the direction of flow, have a generally conical or slightly curved and widening shape, and the area of the cross-section of flow along the flow channel (24) being one of constant cross-section or of reduced cross-section, wherein the blade leading edges (34) project axially upstream ahead of the hub (14) in the direction of the entry opening (28).

2. A blower according to claim 1, wherein the guide surface (22) in the blade zone is axially at a smaller angle than that of the hub (14).

3. A blower according to claim 1, wherein the guide surface (22) in the blade zone is generally in the shape of a truncated cone with a cone angle of between 20° and 60°.

4. A blower according to one of claim 1, wherein the hub (14) in the blade zone is generally in the shape of a truncated cone with a cone angle of between 80° and 110°.

5. A blower according to one of claim 1, wherein the hub is generally parabolic shaped, at least in the crown area (32).

6. A blower according to one of claim 1, wherein the entry segment (26) of the guide surface (22) is curved along an entry radius.

7. A blower according to claim 1, wherein the blade trailing edges (36) at the blade ends form an acute angle relative to the plane of the exit opening (38) of the flow channel (24) against the flow-through direction.

8. A blower according to claim 7, wherein the acute angle is between about 10° and about 20°.

9. A blower according to claim 1, wherein the free blade edges (42) extend adjacent the guide surface (22) with a gap to allow for tolerances.

10. A blower according to claim 1, wherein the blade entry edge (34) exhibits a radius of curvature of 1% to 4% as well as a profile thickness of 2% to 8% of the length of the free blade end (outer) edge.

11. A blower according to claim 1, wherein the rotational drive (20) is an electric motor with outer rotor disposed in a recess (44) of the hub (14).

12. A blower according to claim 1, wherein the blade (16) of the hub (18) are asymmetrically distributed about the periphery of the hub (14).

13. A blower according to claim 1, wherein the guide surface (22) in the blade zone is generally in the shape of a truncated cone with a cone angle of about 40°.

14. A blower according to claim 1, wherein the hub (14) in the blade zone is generally in the shape of a truncated cone with a cone angle of about 95°.

15. A blower including, a) a blower housing (10) including a guide surface (22) that defines the exterior limits of a flow channel (24);

b) a hub (14) that is mounted in the blower housing (10) so as to be rotatable about an axis of rotation (12) and having a hub surface (18) that defines the interior limits of the flow channel (24);

c) a rotary drive (20) for the hub (18) which is disposed within the hub (14);

d) the blade (16) of the hub (18) are configured as radial blades with cylindrical surfaces extending parallel to the axis of rotation (12) and curved backwards against the direction of rotation; and e) the guide surface (22) and the hub (14), in the blade zone between the leading edge (34) of the blade and the trailing edge (36) of the blade, viewed in the direction of flow, have a generally conical or slightly curved and widening shape, and the area of the cross-section of flow along the flow channel (24) being one of constant cross-section or of reduce cross-section, and wherein the area of the cross-section of flow along the flow channel (24) comprises a ring area (40) that is axially open through the blade zone between the leading edge (34) of the blade and the trailing edge (36) of the blade.

* * * * *